United States Patent [19]

Cave

[11] 4,025,114

[45] May 24, 1977

[54] VEHICLE SEAT CUSHION MOUNTING ARRANGEMENT

[75] Inventor: David N. Cave, Hardingstone, England

[73] Assignee: UOP Inc., Des Plaines, Ill.

[22] Filed: Jan. 26, 1976

[21] Appl. No.: 652,350

[30] Foreign Application Priority Data

Jan. 25, 1975 United Kingdom ..... 3406/75

[52] U.S. Cl. ..... 297/452; 5/353.1; 297/455; 297/458; 297/460

[51] Int. Cl.[2] ..... A47C 7/02

[58] Field of Search ..... 5/353.1; 297/452, 455, 297/456, 458, 459, 460, DIG. 1, DIG. 2

[56] References Cited

UNITED STATES PATENTS

| | | | |
|---|---|---|---|
| 3,630,572 | 12/1971 | Homier | 297/DIG. 2 |
| 3,649,974 | 3/1972 | Baruth et al. | 297/458 X |
| 3,853,352 | 12/1974 | Ambrose | 297/DIG. 1 |
| 3,880,467 | 4/1975 | Tischler | 297/458 X |

*Primary Examiner*—James C. Mitchell
*Attorney, Agent, or Firm*—James R. Hoatson, Jr.; Barry L. Clark; William H. Page, II

[57] ABSTRACT

Vehicle seat cushion which has a cover fastened to a wire frame molded into its bottom is secured to a metal seat pan by means of notched tabs struck up from the metal pan or to equivalent attachment members secured to the seat pan.

5 Claims, 2 Drawing Figures

VEHICLE SEAT CUSHION MOUNTING ARRANGEMENT

BACKGROUND OF THE INVENTION

This invention relates to vehicle seats, and in particular to a vehicle seat which comprises a substantially rigid seat pan which is trough-shaped in transverse section and in which a seat cushion is mounted. However, when such a seat cushion includes a cover or skin, the problem exists of securing this cover to the seat pan.

SUMMARY OF THE INVENTION

According to the present invention there is provided a vehicle seat comprising a base such as a metal seat pan, a cushion of foam material, first securing means such as a wire frame abutting or molded into the foam material, and second securing means such as integral struck-up tabs positioned on said base in locking engagement with the first securing means to secure the cushion to the base. A cover extends over the cushion and is attached to the first securing means. The first and second securing means are held together by one or more biassing forces acting transversely of said base, such as the resiliency of the wire frame.

BRIEF DESCRIPTION OF THE DRAWINGS

The invention will now be particularly described, by way of example, with reference to the accompanying drawings in which.

DETAILED DESCRIPTION OF THE INVENTION

Figure 1:
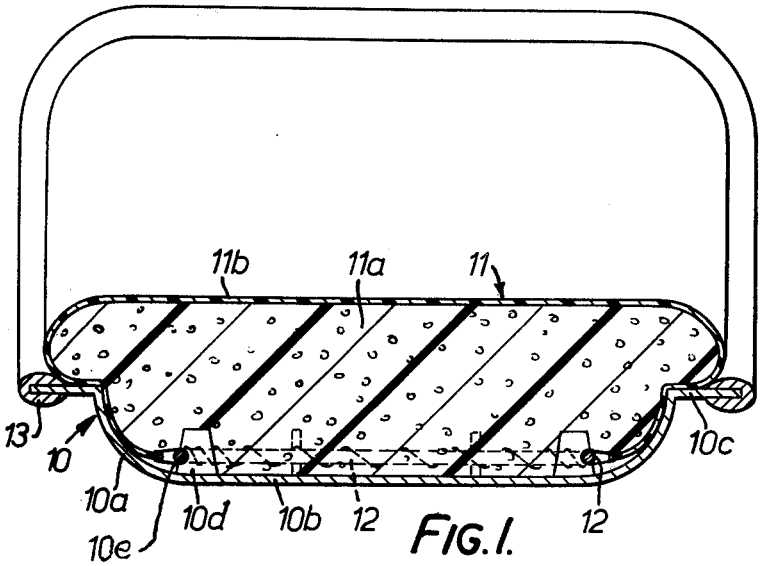
FIG. 1 is a cross-section in a vertical plane through a vehicle seat.
Figure 2:
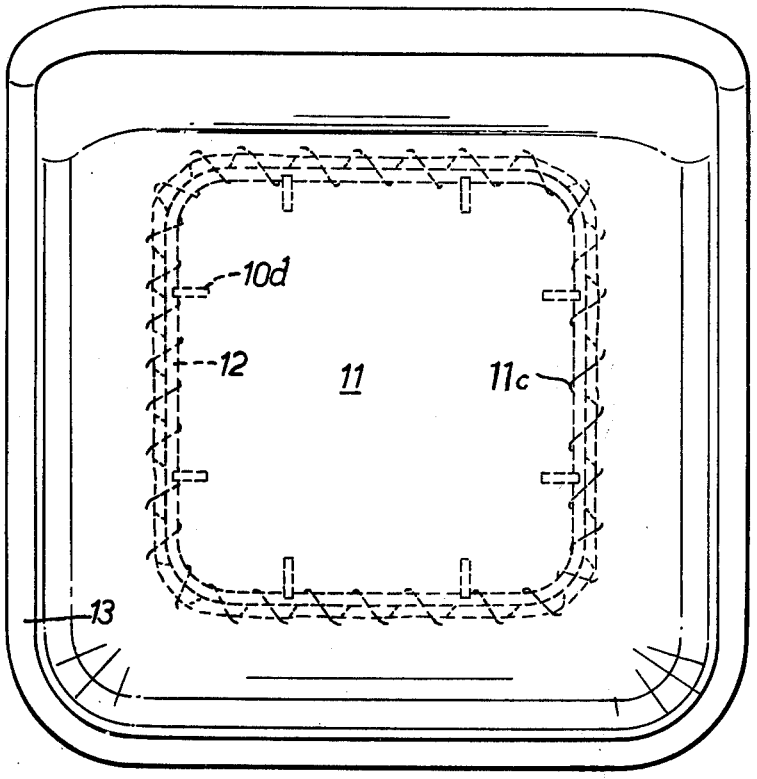
FIG. 2 is a plan view of the seat of FIG. 1.

The vehicle seat shown in the drawing comprises a trough-shaped sheet-metal pan 10 having sides 10*a* which curve upwardly from a horizontal base portion 10*b* and merge into a horizontally-outwardly directed peripheral flange 10*c*.

The seat cushion 11 consists of a molded foam pad 11*a*, such as of polyurethane foam, which is shaped to provide a lower portion which fits into the trough-shaped recess of the seat pan and an upper portion which extends above and partially overlies the peripheral flange. In the operation of molding the foam pad, a rectangular frame of wire 12 is molded into the lower portion so that it is inset a short distance from the sides of the pad and lies very close to the undersurface of the lower portion of the pad. As an alternative to being molded into the foam pad, it could merely lie against the undersurface of the pad.

The foam pad is molded on to, or merely covered by, a cover or skin 11*b*, such as a sheet of leather-simulating plastic, whose area is sufficient to allow the cover to extend over the upper surface of the foam pad and around the sides of the pad, terminating close to the wire frame. The edge portion of the cover is stitched (as shown) or hog-ringed to the wire frame. Alternatively it could be stapled or otherwise secured at intervals to the wire frame.

Means for attaching the wire frame, and hence the cushion, to the seat pan comprise a plurality of upwardly-extending hooks, each in the form of a truncated triangular tab 10*d* of metal which has been struck out of the sheet metal of the seat pan and bent to stand perpendicular to the base of the pan immediately below the wire frame. The plane of each tab is perpendicular to the adjacent wire and each tab has a notch 10*e* formed in one edge of the tab for the reception of the wire.

In assembling the seat, the cover 11*b* extending over the foam pad of the seat cushion is wrapped around the sides of the foam pad and stitched as shown at 11*c*, hog-ringed or otherwise secured at intervals to the wire frame 12. The seat cushion 11 is then fitted into the trough-shaped recess of the seat pan so that the wire frame 12 of the seat cushion lies above the tabs 10*d* upstanding from the base 10*b* of the seat pan. The seat cushion 11 is then pressed down into the pan to cause the wire frame to engage the tapered or inclined leading edge of the tabs and ride down the side of each tab and engage in the notch 10*e* of the tab to secure the cushion in position. The natural resiliency of the wire in the frame causes the wire to be deformed as it moves over the tabs and before it snaps into the notches. The interengagement of the wire frame with the tab can be assisted by the use of a fork-ended tool (not shown) which can be applied to the upper face of the cushion and, through the resilience of the cushion, engage any selected part of the wire frame to press it downwards into the notch of the adjacent tab.

To finish the seat, a U-section trim 13 is preferably fitted over the edge of the peripheral flange.

As an alternative to metal tabs struck out of the base, the securing means can take the form of plastic molded members or tabs (not shown) which are secured in apertures in the base.

What I claim is:

1. A vehicle seat comprising a base, a cushion of foam material, first securing means comprising a wire frame abutting or molded into the foam material, second securing means comprising upstanding hook portions integral with said base and positioned in locking engagement with the first securing means to secure the cushion to the base, and a cover extending over the cushion and attached to the first securing means, the first and second securing means being held together by one or more biassing forces acting transversely of said base.

2. A vehicle seat according to claim 1 wherein the wire in said wire frame is resiliently deformed as it is assembled into locking engagement with said second securing means, the resiliency of said wire providing said biassing forces.

3. A vehicle seat according to claim 2 wherein said hook portions on the base comprise tabs upstanding from the base and integral therewith, each of said tabs having a notch therein directed toward the adjacent portion of the wire frame for receiving said portion of the frame therein.

4. A vehicle seat according to claim 3 wherein the leading surfaces of the tabs which contain the notches are inclined to the direction in which the cushion is moved toward the base during assembly in order to engage the frame with the tabs and progressively deform the frame as the frame is pressed on to said tabs until it snaps into the notches to lock the frame to the tabs.

5. A vehicle seat according to claim 1 wherein the base is a rigid trough-shaped seat pan.

* * * * *